US010272712B2

(12) United States Patent
Reddy

(10) Patent No.: US 10,272,712 B2
(45) Date of Patent: Apr. 30, 2019

(54) PLASTIC CARD WITH SECURITY FEATURE

(71) Applicant: ABCORP NA INC., Boston, MA (US)

(72) Inventor: Rahul Reddy, Franklin, MA (US)

(73) Assignee: ABCORP NA INC., Boston, MA (US)

( * ) Notice: Subject to any disclaimer, the term of this patent is extended or adjusted under 35 U.S.C. 154(b) by 0 days.

(21) Appl. No.: 15/975,244

(22) Filed: May 9, 2018

(65) Prior Publication Data

US 2018/0326777 A1 Nov. 15, 2018

Related U.S. Application Data

(60) Provisional application No. 62/503,379, filed on May 9, 2017.

(51) Int. Cl.

| | |
|---|---|
| ***B42D 25/23*** | (2014.01) |
| ***B42D 25/351*** | (2014.01) |
| ***B42D 25/387*** | (2014.01) |
| ***B42D 25/435*** | (2014.01) |

(52) U.S. Cl.

CPC ..... *B42D 25/387* (2014.10); *B42D 25/23* (2014.10); *B42D 25/351* (2014.10); *B42D 25/435* (2014.10)

(58) Field of Classification Search

CPC ... B42D 25/23; B42D 25/351; B42D 2035/36
See application file for complete search history.

(56) References Cited

U.S. PATENT DOCUMENTS

| | | | | |
|---|---|---|---|---|
| 4,304,809 | A * | 12/1981 | Moraw | B42D 25/351 283/114 |
| 8,568,864 | B2 * | 10/2013 | Syrjanen | B42D 25/351 428/195.1 |
| 2006/0249951 | A1 * | 11/2006 | Cruikshank | B42D 25/351 283/92 |
| 2007/0194129 | A1 * | 8/2007 | Jones | B42D 25/00 235/491 |

(Continued)

FOREIGN PATENT DOCUMENTS

| | | | | |
|---|---|---|---|---|
| EP | 2501554 | B1 * | 9/2015 | B42D 25/351 |
| GB | 2538491 | A * | 11/2016 | B42D 25/351 |

(Continued)

*Primary Examiner* — Kyle R Grabowski
(74) *Attorney, Agent, or Firm* — Kriegsman & Kriegsman

(57) ABSTRACT

A plastic card includes a multi-layer card body into which is integrated a window-type security feature. The card body includes a core layer that is laminated between top and bottom opaque print layers. The security feature includes a transparent insert incorporated into the core layer that serves as a light-transmissive card window. Overt and covert print elements are printed onto the top and bottom surfaces, respectively, of top print layer in alignment with the clear insert, with only the overt print element visible in natural light. By contrast, covert print element is only viewable by illuminating the partially light-transmissive top print layer through the insert. Preferably, the overt and covert print elements are tightly nested design elements that render the resulting harmonized image more difficult to replicate by unscrupulous individuals. Additionally, the insert is preferably dosed with a UV brightener to provide a forensic-level of security to the plastic card.

8 Claims, 3 Drawing Sheets

(56) References Cited

U.S. PATENT DOCUMENTS

| | | | | |
|---|---|---|---|---|
| 2011/0139024 | A1* | 6/2011 | Schiffmann | B42D 25/351<br>101/368 |
| 2014/0125050 | A1* | 5/2014 | Liebler | B42D 25/351<br>283/85 |
| 2014/0126765 | A1* | 5/2014 | Tierney | B42D 25/351<br>382/100 |
| 2016/0303889 | A1* | 10/2016 | Gutmann | B42D 25/351 |
| 2018/0134064 | A1* | 5/2018 | Ballabio | B42D 25/351 |
| 2018/0147881 | A1* | 5/2018 | Endres | B42D 25/351 |

FOREIGN PATENT DOCUMENTS

| | | | | |
|---|---|---|---|---|
| WO | WO-2016169650 | A1 * | 10/2016 | B42D 25/351 |
| WO | WO-2017089901 | A2 * | 6/2017 | B42D 25/351 |

* cited by examiner

PLASTIC CARD WITH SECURITY FEATURE

FIELD OF THE INVENTION

The present invention relates generally to plastic cards and, more particularly, to plastic cards with security features integrated therein to verify authenticity.

BACKGROUND OF THE INVENTION

Plastic cards are well known in the art and are commonly used in a wide variety of different applications. Most notably, plastic cards are constructed for use as, inter alia, commercial transaction cards (e.g. bank cards, credit cards, gift cards, membership cards, loyalty cards, phone cards and the like), identification cards (e.g. driver's licenses, resident cards and the like) and access cards (e.g. key cards, transportation cards and the like).

Plastic cards of the type as described above are traditionally mass-produced by laminating together multiple, enlarged, sheets of durable plastic material, such as polyvinyl chloride (PVC), polyethylene terephthalate (PET), acrylonitrile butadiene styrene (ABS) or polycarbonate. In a subsequent manufacturing step, a plurality of individual cards (typically 24-96 cards) are then punched, cut out or otherwise separated from the multi-layered sheet, or stack, with each resultant card produced in a size and shape in compliance with industry standards. Often, as part of a final personalization step, each card is laser marked or printed using thermal inks with certain unique indicia, such as a name, photograph and/or identification number.

It has been found that unscrupulous individuals routinely attempt to produce counterfeit cards in order to engage in illicit activities including, among other things, identity or property theft. Accordingly, plastic cards are commonly designed with different types of security features to preclude unscrupulous individuals from accurately replicating authentic plastic cards.

One type of security feature commonly incorporated into plastic cards is a transparent window feature. A window feature is created by integrating a clear insert directly into one layer of the card body. The incorporation of a transparent window into the card body serves as a direct countermeasure against the fabrication of counterfeit cards though image scanning, as a clear window is difficult to reproduce using traditional light-based image reproduction techniques.

To manufacture a plastic card with a window feature, a clear insert is typically fittingly disposed within a transverse bore formed in at least one core layer prior to the lamination process. The core plastic layer is then sandwiched between one or more transparent plastic layers to form the card body. Accordingly, upon lamination, the clear insert creates a small, fully transparent window within a designated location in the card. During the card personalization process, a unique marking (e.g. a reduce-sized image, emblem or signature) is then often laser engraved onto the outer surface of the card in alignment with the clear insert to render the window feature even more difficult to replicate by unscrupulous individuals.

As can be appreciated, a window feature is an overt security feature, meaning that the insert and any unique marking printed thereon can be instantly verified by the naked eye (i.e. without the need of any specialized equipment). In the art, overt security features of this type are identified as surface, or level 1, security features, which are the lowest level of security coverage used to protect card authenticity (e.g. to protect identity information).

Although window features of the type described above are commonly used in the art, an influx in unscrupulous behavior in the field, including identity theft, has necessitated that greater levels of security features be incorporated into plastic cards. In particular, it has been found that there is a distinct need for plastic cards that include either embedded, or level 2, security features (e.g. biometric data that is only retrievable using specialized equipment) and/or forensic, or level 3, security features (e.g. data not directly retrievable from the card without the use of authorized forensic tools).

SUMMARY OF THE INVENTION

It is an object of the invention to provide a new and improved plastic card.

It is another object of the present invention to provide a plastic card with one or more security features to verify authenticity.

It is yet another object of the present invention to provide a plastic card of the type as described above wherein the security features are difficult to replicate by potential counterfeiters.

It is still another object of the present invention to provide a plastic card of the type as described above wherein the security features provide embedded and/or forensic levels of card security.

It is yet still another object of the present invention to provide a plastic card of the type as described above that has a limited number of parts and is inexpensive to manufacture.

Accordingly, as a feature of the present invention, there is provided a plastic card comprising a plastic card, comprising (a) a card body, and (b) a security feature in the card body, the security feature comprising an overt print element in the card body and a covert print element in the card body.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

Plastic Card 11

Figure 1:
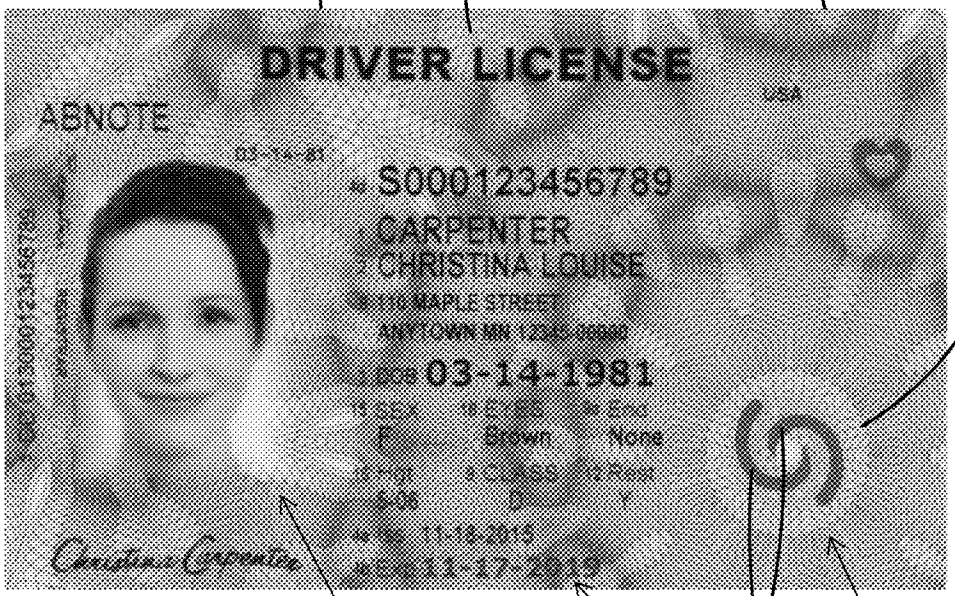
FIG. 1 is a front plan view of a plastic card constructed according to the teachings of the present invention.
Figure 2:
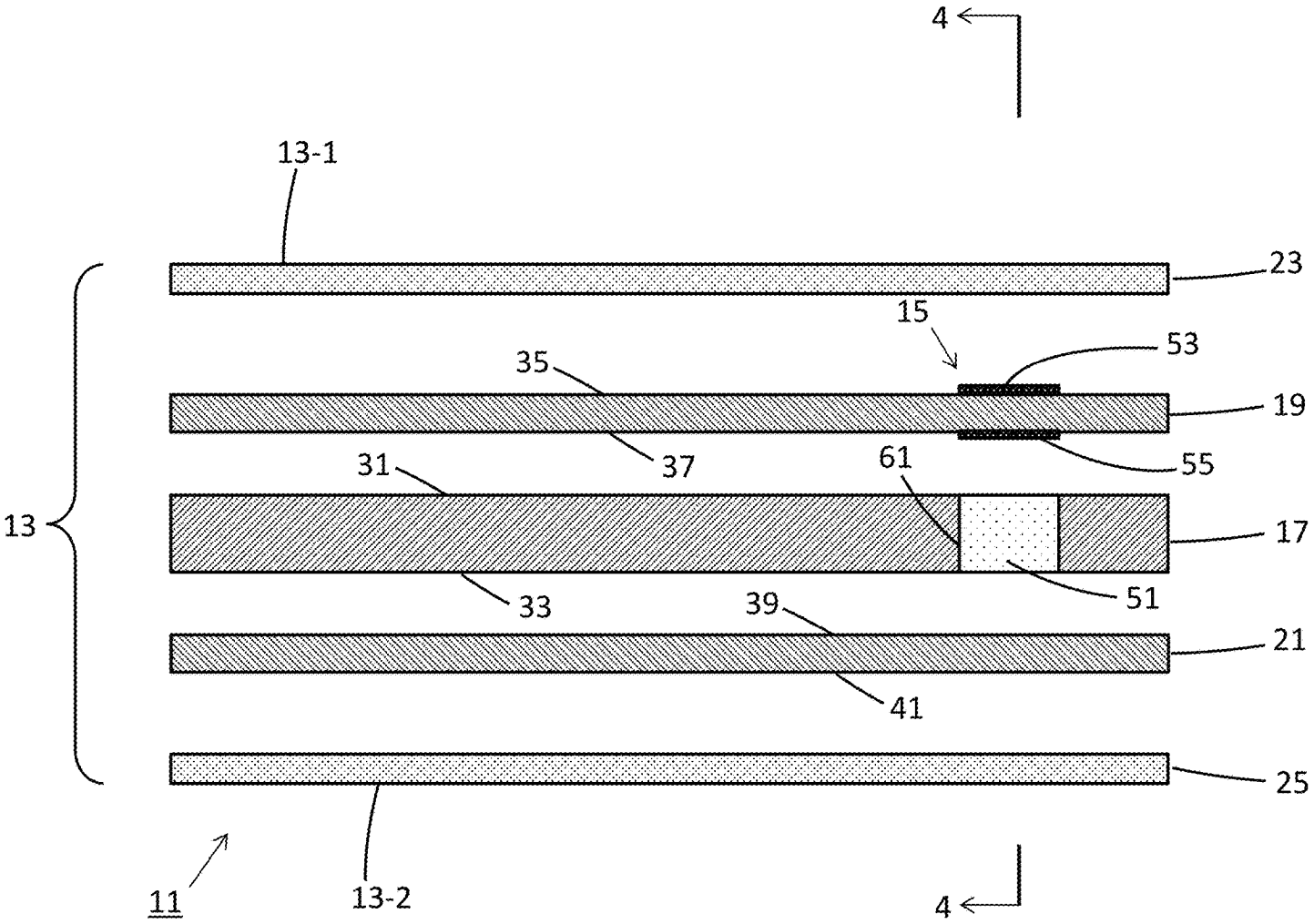
FIG. 2 is an exploded, side view of the plastic card shown in FIG. 1, the plastic card being shown without artwork or personalization for ease of illustration.

Referring now to FIGS. 1 and 2, there is shown a plastic card constructed according to the teachings of the present invention, the plastic card being identified generally by reference numeral 11. As will be explained in detail below, plastic card 11 is constructed with enhanced security features to verify authenticity.

As defined herein, the term "plastic card" not only encompasses card-like structures used in commercial transaction, identification and secure access applications, but also other similar types of plastic items commonly used for identification purposes including, but not limited, to credentials and passport data pages.

Plastic card 11 comprises a multi-layer card body 13 and a security feature 15 incorporated into card body 13. Although not shown herein, certain additional elements (e.g. an integrated circuit (IC)) could be incorporated into card body 13 to provide plastic card 11 with further transactional and/or authentication capabilities.

Card body 13 is preferably constructed from a plurality of enlarged sheets of durable plastic material. The stacked plastic sheets are then laminated together and punched to form a plurality of individual card bodies 13, each card body 13 being generally rectangular in shape and having an enlarged, flattened, front surface 13-1, an enlarged, flattened, rear surface 13-2, and a thin, continuous side edge 13-3.

As seen most clearly in FIG. 2, card body 13 comprises a core layer 17 that is disposed between a top print layer 19 and a bottom print layer 21. In addition, a pair of opposing transparent overlays 23 and 25 is disposed on the top and bottom surfaces, respectively, of the stack. As referenced above, layers 17, 19, 21, 23, and 25 are permanently joined together through a lamination process to form unitary card body 13.

Core layer 17 is preferably constructed from a sheet of opaque, white, polycarbonate material with a thickness of approximately 12 mils (305 microns). As can be seen, core layer 17 comprises a substantially flat top surface 31 and a substantially flat bottom surface 33.

Each of top and bottom print layers 19 and 21 is preferably constructed from a sheet of a white polycarbonate material that is partially light-transmissive. As can be seen, top print layer 19 comprises a substantially flat top surface 35 and a substantially flat bottom surface 37. Similarly, bottom print layer 21 comprises a substantially flat top surface 39 and a substantially flat bottom surface 41.

Each of layers 19 and 21 has a thickness of approximately 6 mils (150 microns) and is designed to receive printed matter in order to, inter alia, decorate/or and identify card 11. Notably, front artwork (e.g. background art viewable from front 13-1 of card 13) is preferably printed on top surface 35 of print layer 19 and back artwork (e.g. background art viewable from rear 13-2 of card 13) is preferably printed on bottom surface 41 of card 11. However, for ease of illustration, front and back artwork is not shown in FIG. 2 on top and bottom print layers 19 and 21, respectively.

Each of top and bottom overlays 23 and 25 is preferably constructed from a sheet of transparent, laser-markable, polycarbonate material with a thickness of approximately 4 mils (100 microns). As can be appreciated, overlays 23 and 25 are designed to protect card body 13 from common environmental conditions as well as receive certain personalized information.

It should be noted that card body 13 is not limited to the number and arrangement of layers as described herein. Rather, it is to be understood that the number, construction and dimensions of the individual layers could be modified without departing from the spirit of the present invention as long as the overall dimensions of card body 13 remain generally the same in order to render card 11 compliant with industry standards.

Additionally, it should be noted that each layer in card body 13 is not limited to the particular materials set forth in detail above. Rather, it is to be understood that each of layers 17, 19, 21 23 and 25 could be constructed from other suitable materials used in the manufacture of plastic cards including, but not limited to, polyvinyl chloride (PVC), polyethylene terephthalate (PET), acrylonitrile butadiene styrene (ABS) or composites thereof.

As referenced briefly above, overlays 23 and 25 are laser-markable and therefore adapted to be printed/laser marked with certain customized, or personalized, information upon completion of the manufacture of card body 13. For instance, in FIG. 1, card body 13 is shown printed with personalized matter including, inter alia, a photograph 45 as well as personal data 47 (e.g. name, date of birth, social security number, etc.).

As noted briefly above, card 11 is incorporated with a novel window-type security feature 15 to verify authenticity. As will be explained in detail below, security feature 15 includes a pair of complementary print elements that are acutely registered in alignment within a common window, wherein only one of the complementary pair of print elements is a surface feature that is viewable in plain sight.

Window-Type Security Feature 15

As referenced above, plastic card 11 includes a uniquely designed security feature 15 that serves as a principal novel feature of the present invention. As will be explained in detail below, security feature 15 includes both overt and covert print features, thereby rendering plastic card 11 less susceptible to unauthorized replication.

Figure 3:
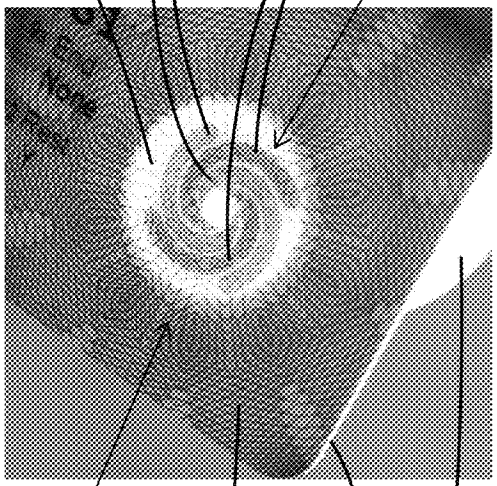
FIG. 3 is an enlarged, fragmentary, top perspective view of the plastic card shown in FIG. 1, the plastic card being shown with a light source to illustrate a security feature incorporated into the plastic card.

Specifically, referring now to FIGS. 2 and 3, security feature 15 includes a transparent insert 51 in card body 13, an overt print element, or feature, 53 in card body 13 that is readily visible to the naked eye, and a covert print element, or feature, 55 in card body 13 that is only visible with the use of a designated instrument, such as a light source. Together, the overt and covert print elements 53 and 55 serve as two complementary components of a harmonized design, or image, 57 that is registered within insert 51. Preferably, image 57 covers only a portion of insert 51 to facilitate the transmission of light therethrough.

Accordingly, in plain sight, only overt print feature 53 is visible. In order to view the entire harmonized image 57, light needs to be shined directly through insert 51. This introduction of light into card body 13 thereby enables covert print feature 55 to be visible through partially light-transmissive print layer 19. In this capacity, the separation and unique visual aspects of complementary print features 53 and 55 provide card 11 with an enhanced level of security, which is highly desirable.

As seen most clearly in FIG. 2, insert, or window, 51 is preferably constructed of a transparent plastic material and is fittingly disposed within a vertical bore 61 extending transversely through core layer 17 (I.e. from top surface 31 to bottom surface 33). Preferably, insert 51 is dimensioned to lie generally flush with top and bottom surfaces 31 and 33 of core layer 17.

It is to be understood that clear insert 51 facilitates transmission of light through card body 13 which, in turn, enables fine details of print features 53 and 55 to be selectively visible. Also, because clear insert 51 is fully embedded within card body 13, insert 51 could be treated to provide plastic card 11 with additional embedded, or even forensic, security features, as will be explained further in detail below.

Furthermore, it should be noted that clear insert 51 creates a region in card body 13 that is more light-transmissive than the remainder of the card. However, at the same time, top and bottom print layers 19 and 21 largely obscure the visibility of clear insert 51 in plain view. As a result, because embedded insert 51 is not readily apparent without the use of an external light source, the presence of insert 51, by itself, provides plastic card 11 with a certain degree of useful card security.

Despite the inherent advantages afforded through its inclusion in card 11, plastic insert 51 is not essential to the visibility of overt print element 53 or covert print element 55. Instead, it is to be understood that insert 51 could be removed from plastic card 11 without departing from the spirit of the present invention.

For instance, in lieu of insert 51, it is envisioned that core layer 17 could be reduced significantly in thickness, punched with a hole in the desired shape for the window, and sandwiched between two clear plastic overlays. Accordingly, upon lamination, the hole in the reduced-thickness core layer will be effectively covered by the pair of clear overlays. As a result, a clear window is created in the resultant stack without the need for a transparent insert to be disposed within the hole in the core layer.

As seen most clearly in FIG. 2, overt print element 53 is printed onto top surface 35 of print layer 19 in direct vertical alignment with clear insert 51. Because top overlay 23 is transparent, overt print feature 53 is readily visible to the naked eye when viewing card 11 from front surface 13-1.

By contrast, covert print element 55 is printed onto bottom surface 37 of print layer 19 in direct vertical alignment with clear insert 51. Due to the opaque nature of print layer 19, covert print element 55 is not naturally visible to the naked eye when viewing card 11 from front surface 13-1. Rather, a designated light source is required to transmit enough light through partially light-transmissive print layer 19 that covert print element 55 becomes visible when viewing card 11 from front surface 13-1.

It should be noted that covert print feature 55 could be printed onto alternative interior surfaces within card body 13 without departing from the spirit of the present invention. For instance, it is to be understood that covert print element 55 could be alternatively printed onto either top surface 31 of core layer 17, bottom surface 33 of core layer 17, or top surface 39 of print layer 21 without compromising the functionality of security feature 15.

As referenced above, the opaque nature of top print layer 19 shields, or disguises, covert print element 55 and thereby renders it imperceptible to the naked eye when viewing the front of card 11. Instead, covert print element 55 is only visible when a light source is placed in close proximity to card 11. For example, as shown in FIG. 3, with back surface 13-1 of card body 13 disposed against a light source 65 (e.g. a flashlight or other similar device that emits a focused stream of light), enough light propagates through overlay 25, bottom print layer 21, clear insert 51 and top print layer 19 to render covert print feature 55 visible when viewing the front of plastic card 11.

In the present embodiment, overt and covert print elements 53 and 55 are represented as complementary pairs of arcuate-shaped configurations that are tightly nested together to form a spiral-like harmonized image 57, as seen most clearly in FIG. 3. Preferably, each of print elements 53 and 55 is printed in a unique color to further accentuate the differentiation in features and thereby create a shadow-like print feature.

However, it should be noted that print elements 53 and 55 need not be limited to any particular configuration, style or color. Rather, it is to be understood that overt and covert print elements 53 and 55 could be modified in appearance to form any complementary set of design elements without departing from the spirit of the present invention.

It should be noted that the tightly nested relationship between overt and covert print features 53 and 55 creates an additional level of security to card 11. Namely, overt and covert print features 53 and 55 require highly acute alignment prior to lamination of card body 13. Any misalignment between print elements 53 and 55 would thereby create an offset, or potentially overlapping, harmonized image 57. Any perceivable lack of precision between overt and covert print elements 53 and 55 would indicate that such a card is potentially counterfeit.

Alternate Embodiments and Design Modifications

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

As an example, it is envisioned that plastic card 11 could be constructed without overt print element 53 without departing from the spirit of the present invention. In particular, because covert print element 55 is embedded in card body 13 and undetectable in plain sight, the inclusion of a single, covert print element 55 may provide plastic card 11 with the requisite degree of card security in certain applications.

As another example, it should be noted that harmonized image 57 need not be limited to the two separate print elements referenced above (i.e. print elements 53 and 55). Rather, it is envisioned that harmonized image 57 could be formed using three or more separate print elements without departing from the spirit of the present invention. Namely, plastic card 11 could be constructed with a first overt print element 53 printed on top surface 35 of top print layer 19, a covert print element 55 printed on bottom surface 37 of top print layer 19 and a second overt print element (not shown) printed on bottom surface 41 of bottom print layer 21. As can be appreciated, the inclusion of additional print elements renders image alignment during card manufacture even more difficult to achieve, thereby increasing the overall degree of card security, which is highly desirable.

As yet another example, for further validation of authenticity, card body 13 may be treated with additional security features to render plastic card 11 even more difficult to counterfeit. In fact, certain additional features could be incorporated into plastic card 11 that are only identifiable by transversely cutting card body 13 and examining its cross-section.

For instance, a pigment could be added to transparent insert 51 that produces a discernable coloring when exposed to a certain wavelength of light. Because clear insert 51 is fully embedded in card body 13 and thereby inaccessible after lamination of card 11, the aforementioned security feature would provide card 11 with a forensic level of card security (i.e. level 3 card security).

For instance, transparent insert 51 may be dosed with an optical brightener, or similar pigment, which absorbs ultraviolet (UV) light and, in turn, re-emits visible colored light (e.g. red or blue light) through fluorescence.

Figure 4:
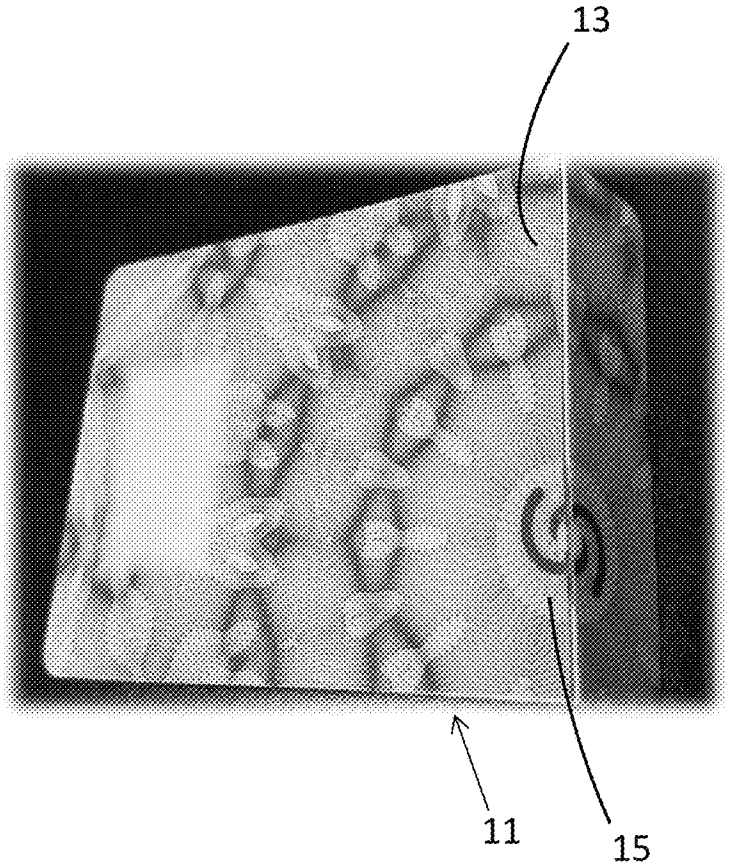
FIG. 4 is a front plan view of the plastic card shown in FIG. 2, the card being shown partially transversely severed along lines 4-4, the plastic card also being shown prior to personalization for ease of illustration.

Because clear insert 51 is disposed between opaque print layers 19 and 21, any UV brightener added to insert 51 would not be readily perceivable when plastic card 11 is exposed to UV light. Rather, the optical brightener added to clear insert 51 is only perceivable by transversely cutting card 11 through security feature 15 (i.e. resulting in the permanent destruction of the card), as shown in FIG. 4.

Figure 5:
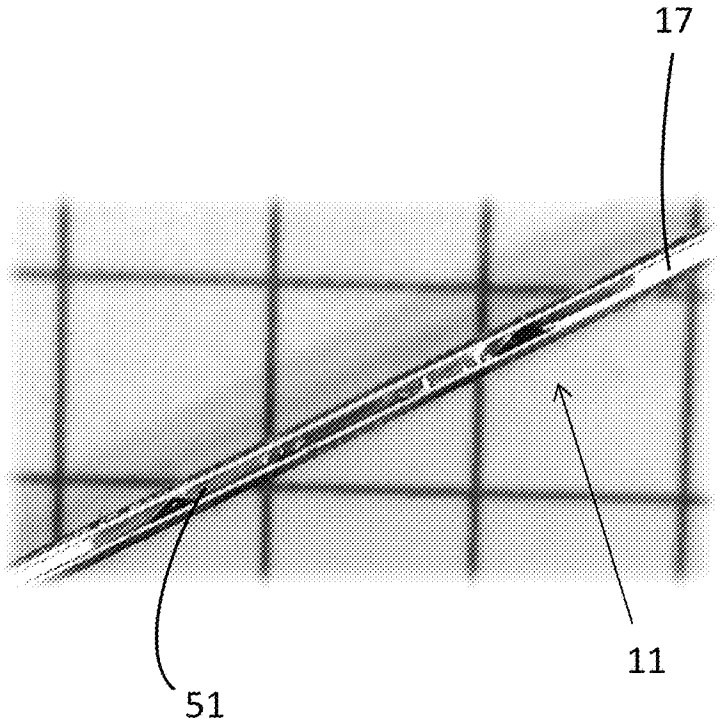
FIG. 5 is an enlarged, section view of the plastic card shown in FIG. 2, taken along lines 4-4.

With card 11 transversely severed through security feature 15, illumination of the resultant cross-section under ultraviolet (UV) light, as shown in FIG. 5, creates luminescence of clear insert 51 in a unique, readily identifiable color. In this manner, clear insert 51 provides a forensic-level security feature, which is highly desirable.

Furthermore, if core layer 17 (and/or print layers 19 and 21) is similarly treated with an optical brightener that emits light at a different wavelength, the illumination of the severed card under UV light will produce a two-tone luminesce in cross-section, with insert 51 illuminating in one color (e.g. pink) and core layer 17 illuminating in another color (e.g. blue). The unique contrast in luminescence colors provides a readily discernable indication of card authenticity.

Although less secure than a cross-sectional examination, it should also be noted that luminescence of core layer 19 could be examined without destroying card 11 by viewing card edge 13-3 under UV light.

Features and Advantages of the Present Invention

The construction of plastic card 11 in the manner set forth above affords a number of notable advantages over plastic cards which are well known in the art.

As a first advantage, plastic card 11 is constructed to include a covert, or embedded, security feature (i.e. a level 2 security feature) that can only be examined using a designated instrument (i.e. the security feature is not fully apparent in plain sight). As such, potential counterfeiters may not even be aware that plastic card 11 includes security feature 15. Rather, verification of plastic card 11 requires the preexisting knowledge that a designated tool (in this case, a lamp or other similar light source) is needed to illuminate security feature 15 to the extent necessary to view embedded print element 55 of harmonized image 57.

As a second advantage, the tightly nested relationship between overt and covert print elements 53 and 55 creates an additional layer of security due to the high level of precision required to properly align the two separately printed components of harmonized image 57.

As a third advantage, overt and covert print features 53 and 55 are preprinted onto internal print layer 19 during card manufacture (i.e. prior to the lamination and personalization processes). As a result, overt and covert print features 53 and 55 are considerably more difficult to replicate than indicia that is simply laser printed onto an external surface of the card.

As a fourth advantage, clear insert 51 is completely embedded within card body 13 and, in turn, partially obscured by white polycarbonate print layers 19 and 21. Accordingly, by pretreating clear insert 51 and/or other embedded layers within card body 13 with pigments or additional ink layers, forensic security features can be integrated into plastic card 11 to ensure authenticity.

What is claimed is:

1. A plastic card, comprising:

(a) a card body comprising, (i) a core layer having a top surface, a bottom surface, a vertical bore, and a continuous perimeter, the vertical bore extending from the top surface to the bottom surface in a spaced apart relationship relative to the side edge of the card body, the core layer being dosed with a first pigment, (ii) a first print layer having a top surface and a bottom surface, and (iii) a second print layer having a top surface and a bottom surface, the core layer being disposed between the first and second print layers; and (b) a security feature in the card body, the security feature comprising, (i) a clear insert fittingly disposed within the vertical bore to form a transparent window that is fully embedded within the card body, the clear insert being dosed with a second pigment, (ii) an overt print element printed onto the top surface of the first print layer in alignment with the transparent window, and (iii) a covert print element printed onto the bottom surface of the first print layer in alignment with the transparent window;

(c) wherein each of the first and second pigments absorbs ultraviolet light and re-emits visible light through fluorescence, the first and second pigments fluorescing at different wavelengths.

2. The plastic card as claimed in claim 1 wherein each of the first and second print layers is constructed of an opaque polymer material that is partially light-transmissive.

3. The plastic card as claimed in claim 2 wherein the second print layer is in the absence of an opening.

4. The plastic card as claimed in claim 3 further comprising a pair of transparent overlays, wherein the core layer and the first and second print layers are together disposed between the pair of transparent overlays.

5. The plastic card as claimed in claim 4 wherein each of the pair of transparent overlays is laser markable.

6. The plastic card as claimed in claim 1 wherein the overt and covert print elements are complementary components of a harmonized image.

7. The plastic card as claimed in claim 6 wherein the overt and covert print elements are nested together to form the harmonized image.

8. The plastic card as claimed in claim 7 wherein the harmonized image is generally spiral-shaped.

* * * * *